United States Patent [19]

Toshishige

[11] Patent Number: 4,566,662

[45] Date of Patent: Jan. 28, 1986

[54] BATH ACCESSORIES, AND DECORATIVE WALL FLANGES THEREOF

[75] Inventor: Yoshinori Toshishige, Tokyo, Japan

[73] Assignee: Reliance Incorporated, Tokyo, Japan

[21] Appl. No.: 617,923

[22] Filed: Jun. 6, 1984

[51] Int. Cl.[4] ..... F16M 13/00

[52] U.S. Cl. ..... 248/222.1; D8/350

[58] Field of Search ..... 248/222.1, 222.2, 222.3, 248/223.3, 223.4, 224.3, 225.2; D8/350; 70/452

[56] References Cited

U.S. PATENT DOCUMENTS

| | | | |
|---|---|---|---|
| D. 176,282 | 12/1955 | Patriquin | D8/350 |
| D. 185,005 | 4/1959 | Kubota | D8/350 |
| 241,991 | 5/1881 | Jones | 248/222.2 |
| 1,940,888 | 12/1933 | Smith | 248/222.1 |
| 1,970,473 | 8/1934 | Parker | 248/222.1 |
| 2,506,602 | 5/1950 | Laystrom | 248/222.1 |
| 2,512,209 | 6/1950 | Marchand | 248/222.1 |
| 2,815,655 | 12/1957 | Boer | 70/452 |

*Primary Examiner*—J. Franklin Foss
*Assistant Examiner*—Robert A. Olson
*Attorney, Agent, or Firm*—Shlesinger, Fitzsimmons & Shlesinger

[57] ABSTRACT

In bath accessories in which a projecting fixture such as a soap holder, towel ring, and so on is mounted onto a wall surface through a wall plate which is fitted by screws to the wall surface and which is concealed by an open base of the projecting fixture, a novel decorative wall flange for enhancing the ornamentality of the bath accessories. Said decorative wall flange, central opening of which surrounds the wall plate and base area of which is oriented with the open base of the projecting fixture and sandwiched between said open base of the projecting fixture and the wall surface when it is assembled into the bath accessories, is removably mounted onto the wall surface solely by means of fastening means of the projecting fixture exerting on side walls of the wall plate.

1 Claim, 5 Drawing Figures

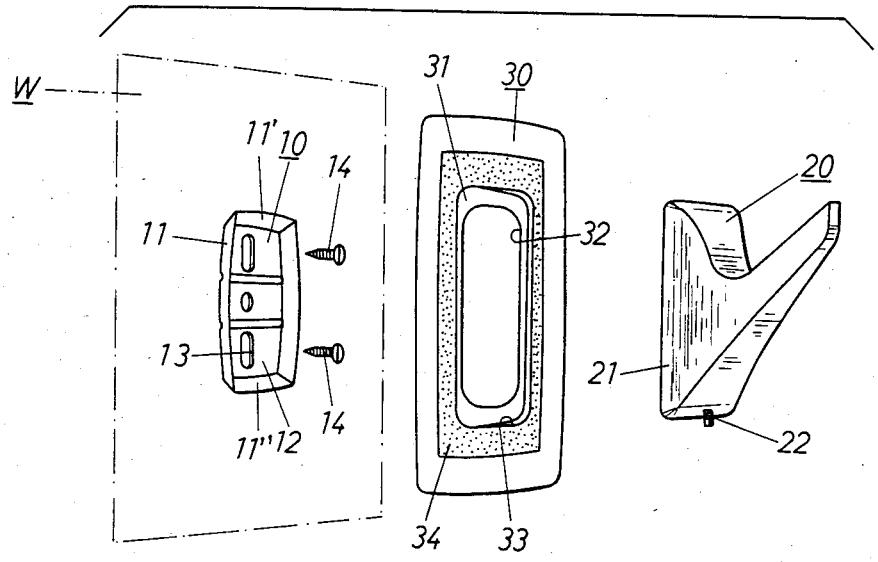
Fig. 1
Fig. 2
PRIOR ART
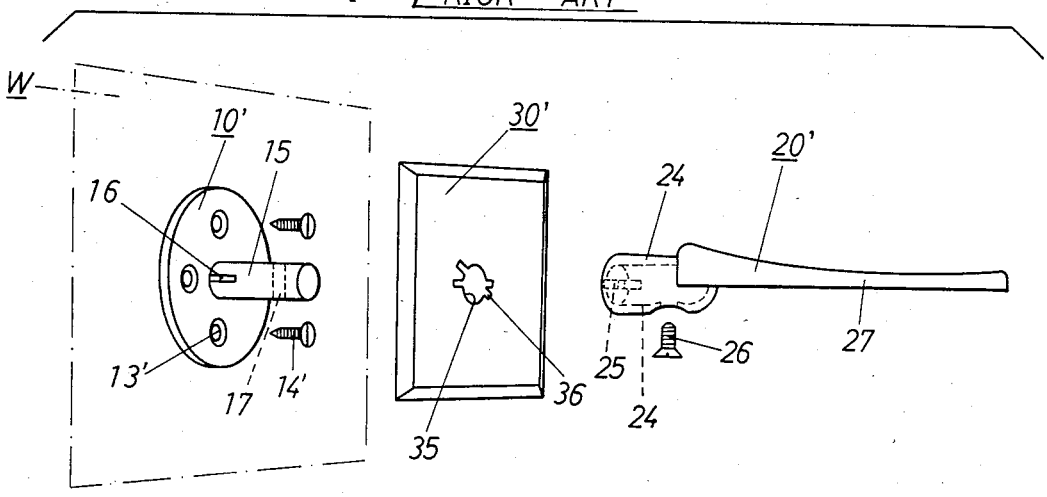

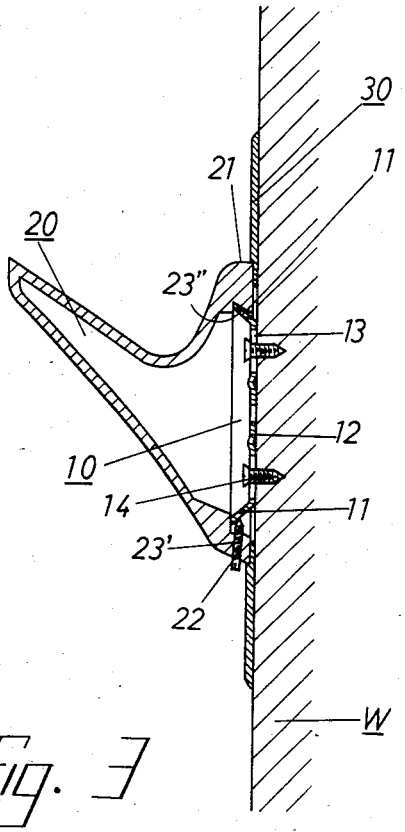
Fig. 3
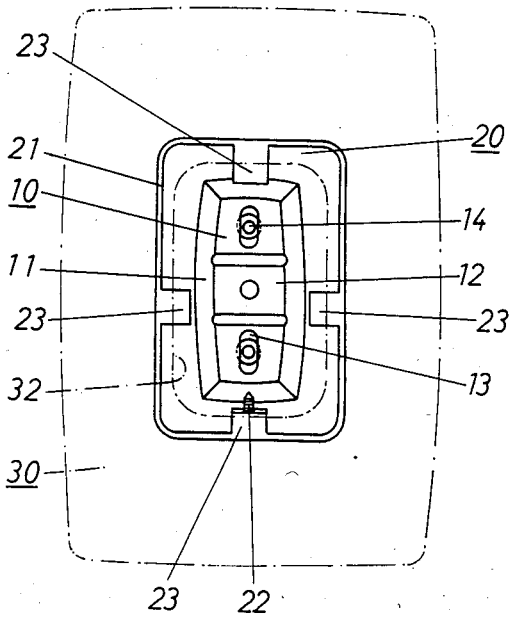
Fig. 4
Fig. 5
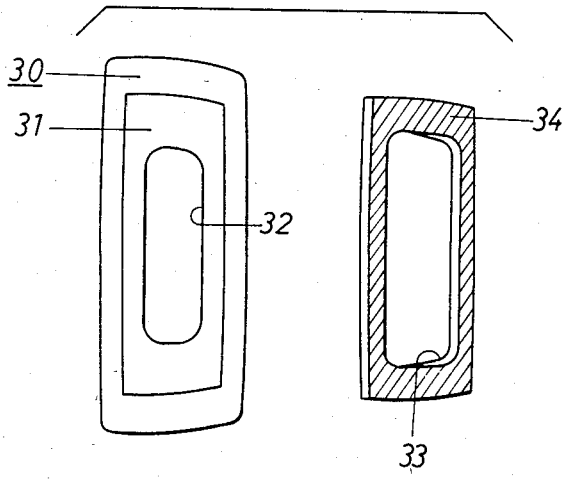

BATH ACCESSORIES, AND DECORATIVE WALL FLANGES THEREOF

BRIEF DESCRIPTION OF THE DRAWING

In the accompanying drawing in which embodiments of bath accessories made in accordance with this invention are illustrated, with an example of conventional bath accessory as comparison therefor;

FIG. 1 is a perspective view of a bath accessory made in accordance with this invention, in which components are shown as disassembled, FIG. 2 is a perspective view similar to FIG. 2, but illustrating a conventional bath accessory unit, FIG. 3 is a sectional side view of the bath accessory illustrated by FIG. 1, and assembled, and fixed to a wall surface, FIG. 4 is a back side view of FIG. 3, in which the wall surface is taken off, and a decorative wall flange thereof is shown by chain lines for easier understanding, and FIG. 5 is a perspective view of another embodiment of the decorative wall flange in which its parts are disassembled.

BACKGROUND OF THE INVENTION

There are various kinds of bath accessories such as soap holders, towel rings, and so on which are to be mounted on a wall surface with concealed screws. A kind of them is consisted of, as illustrated in FIG. 1 and as known in Japanese Utility Model Publication No. 40-10275 of Apr. 6, 1965, a boat-shaped wall plate 10, side walls 11 of which are arc-shaped or converged toward a bottom 12 of the plate and which are provided at said bottom with a plurality of holes 13 through which screws 14 are passed to fix the wall plate to a wall surface w; and a projecting fixture 20 such as a hook illustrated in FIG. 1, a rectangular base 21 of which is open and has such dimensions that it can be mounted over the wall plate 10 completely concealing the latter. Said hook 20 has a screw 22 which passes through a threaded hole 23' provided to its rectangular base 21 at a bottom side wall thereof and transversely thereof. Thus, by having the projecting fixture 20, viz., the hook in this instance mounted over the wall plate 10 which has been fixed on the wall surface w, so that its rectangular base 21 is held to a position where it closely abuts at its open edges against the wall surface and at its top inner side wall against the arc-shaped top side wall 11' of the wall plate 10; the screwed-in screw 22 comes into firm abutment with the arc-shaped bottom wall 11'' of the wall plate 10 at any selected suitable point thereof within its height, and consequently firmly holds the hook 20 at the aforementioned position.

The aforementioned kind of bath accessories in which the projecting fixture 20 itself conceals the wall plate 10, do not require any wall flanges such as the one illustrated in FIG. 2 and represented therein by numeral 30'. However, this invention dares to provide bath accessories of the kind illustrated in FIG. 1 with such wall flanges as illustrated in FIG. 1 and represented therein by numeral 30, which novel wall flanges made in accordance with this invention are not for concealing the wall plate 10 or a wall plate such as the one illustrated in FIG. 2 and represented therein generally by numeral 10', but for enhancing ornamentality of the bath accessories.

In order to clarify the difference of this invention which will be described hereinafter more in detail, from conventional bath accessories, a bath accessory illustrated in FIG. 2 as a prior art is explained hereunder more. The wall plate 10' is fitted to the wall surface w by screws 14' which are passed though holes 13' and fastened, and has a projection shaft 15 provided with a key 16. The shaft is passed through a central hole 35 of the wall flange 30', whereby the keys 16 engage with selected ones of key slots 36 of the wall flange 30' so as to orient said flange with respect to the wall plate 10'. A projecting fixture 20' consisting of a soap holder plate 27 in this instance and a connecting shaft 24 which is made integral with the plate 27 and has an axially extending tubular hole 24' and key ways 25 extending coaxially with the hole 24; is fitted to the discal wall plate 10' with the wall flange 30' therebetween by insertedly mounting the tubular hole 24' onto the shaft 15 so as to make the keys 16 engaged with the key ways 25. While the projecting fixture 20' is also thus oriented with respect to the wall plate 10', the axial displacement of the wall flange 30' and soap holder 20' should be prevented by screwing-in a screw 26 through a hole of the holder 20' into a corresponding hole 17 of the shaft 15. Apart from a fact that in this bath accessory, the wall flange 30' is absolutely necessary to conceal the screwed wall plate 10', it needs a number of complicated devices such as the keys 16 and hole 17 on the shaft 15, the key slots 36 on the wall flange 30', and the key ways 25, to have the wall flange and projecting fixture oriented and fixed rightly at their positions. This is not the case in this invention. Much the worse, the wall flange 30' rattles and is axially displaceable, if a distance between the bottom surface of the wall plate 10' and the hole 17 does not exactly coincide with the thickness of wall flange 30'. Such exactness can hardly be expected, because goods such as bath accessories do not belong to precision devices. And, in addition, rough surfaces of a wall will make such exactness more difficult to attain. This is not also the case in this invention.

As further another prior art, a wall flange which has been fixed to a projecting fixture by means of screws inserted from the inner surface of the flange through holes thereon and screwed-in into threaded holes provided to the projecting fixture at positions correspondent to the flange holes, may be mentioned. However, this kind of wall flange screwed to the projecting fixture can not be comparable with this invention, since a novel decorative wall flange made by this invention is, as described hereinafter more in detail, readily attachable to the hook 20 without any specific fastening means and readily replaceable by another decorative flange of a different pattern or color.

BRIEF SUMMARY OF THE INVENTION

As briefly explained above, this invention is to provide a decorative wall flange which is not for concealing a screwed wall plate of bath acessories but exclusively for enhancing decorative ornamentality of them, and which can readily be attachable to them and replaced by another decorative wall flange of a different color or pattern so that a numerous number of combinations of projecting fixtures with wall flanges may easily be attained by consumers.

In more concrete, this invention is to provide, in a bath accessory consisting of a boat-shaped wall plate to be fixed at its bottom to a wall surface and having side walls converged toward its bottom, and of a projecting fixture having at its forward end an accessory such as a hook, soap holder, towel ring and the like and at its open-ended base substantially rectangular wall flanges of such dimensions that can allow the flanges to accomodate therein concealingly the boat-shaped wall plate for having the projecting fixture fixedly engaged to the wall plate by fastening means acting between the flanges and the side walls of the wall plate; a decorative wall flange 30 provided with a central opening 32 larger than plane outer dimensions of the wall plate preferably at its bottom and a base area 31 having a substantially rectangular circumferential boundary 33 which surrounds the central opening with space therebetween, corresponds to the circumferential outer periphery of the wall flanges of the projecting fixture base, and is defined by the inner substantially rectangular periphery of an elevated area 34 which locates surrounding the base area, the decorative wall flange being oriented with respect to the projecting fixture by the engagement of its base area with the openended base of the projecting fixture and being fastened against the wall surface by the aforementioned fastening means when it is assembled to the bath accessory.

PREFERRED EMBODIMENTS

An embodiment of this invention which is illustrated in FIGS. 1, 3, and 4, has been described above. In those figures, numerals 23 represent projections extending inwardly from the rectangular base 21 of the projecting fixture 20. To one of the projections 23 which locates at the lower side of the base 20 in FIG. 4, there is provided the threaded hole 23' for the screw 22, while the other projection 23 which locates oppositely to the aforementioned one of the projections 23, is provided with an inwardly sloped shoulder 23" so that when the projecting fixture is fitted over the boat-shaped wall plate, said other projection 23 does not come out from its engagement with the side walls of the wall plate while the aforementioned one of the projections 23 is firmly held onto the wall plate by the engagement of the screw 22 with said side walls.

In the above constructions, since the screw 22 is engageable with the side walls 11 of the wall plate at any selected height thereof provided that the bottom flanges of the projecting fixture abut to the wall surface w, there is a space for allowing the base area 31 to lie between said bottom flanges and the wall surface. Therefore, the decorative wall flange 30 which can be oriented with respect to the projecting fixture as explained above, can further be fixedly oriented on the wall surface without employing any fastening means than the ones which fasten the projecting fixture 20 to the wall plate 10.

It shall be noted that an outer periphery of the elevated decorative area 34 or of the decorative wall flange as a whole can be any shape rather than rectangle, and can be, for example, circular, oval, and polygonal, while the base area 31 has to be afforded with the outer boundary 33 such as rectangular which substantially fits to the projecting fixture base 21. It shall be noted also that while the central opening 32 of the decorative wall flange 30 is preferably larger than the plan largest dimensions of the wall plate 10, said opening can be larger at least than plan dimensions of the base 12 of the wall plate if the wall flange is placed on the wall surface before screwing the wall plate to the wall surface, though in this instance the wall flange becomes replaceable only when the wall plate 10 is released from the wall.

In FIG. 5, it is illustrated that the decorative elevated area 34 which is integral with the base area 31 in FIGS. 1 and 3, can be made by providing a separate plate onto the base. In addition, the elevated area 34 which is made integral with the base of the decorative wall flange can be overlaid at its surface by affixing a sheet of different patterns or colors. Its surface may be coated by different colors to present unique ornamentality.

I claim:

1. A bathroom accessory, comprising the combination of a generally boat-shaped wall plate having a plane bottom wall one surface of which is disposed to be fixed against a bathroom wall, and the other surface of which has projecting therefrom an integral side wall which surrounds said bottom wall and diverges outwardly therefrom, a fixture having a generally rectangular base disposed to be fixed at one end to said wall plate, and having projecting from its opposite end an integral projection engagable with an article releasably to support the latter on said fixture, said base having in said one end thereof a substantially rectangular recess surrounded by a shoulder of such dimension as to allow said recess concealingly to accommodate therein said boat-shaped wall plate, fastening means disposed to act between said shoulder and said side wall of the wall plate for removably securing said fixture fixedly to said wall plate, and a generally flat, decorative wall flange having therethrough a central opening similar in configuration to and larger than the outer peripheral dimension of said wall plate, and having in one surface thereof a recessed area of substantially rectangular shape, and a decorative plate secured in and and covering part of said area and having therethrough a central opening which corresponds in configuration to the circumferential outer periphery of said shoulder on said fixture base, and which forms in said wall flange an internal shoulder that is spaced outwardly from and surrounds said central opening in said wall flange, said wall flange being disposed to be inserted over said wall plate with the surface thereof opposite its recessed area being seated against the wall on which said wall plate is fixed, and with said shoulder on said base being positioned in said central opening in said decorative plate and seated securely against the remaining portion of said recessed area in the wall flange, thereby to secure said wall flange in proper orientation with respect to said fixture.

* * * * *